US005934408A

United States Patent [19]

Flux

[11] Patent Number: 5,934,408

[45] Date of Patent: Aug. 10, 1999

[54] FALL ARREST DEVICE

[75] Inventor: Peter Robert Flux, Calne, United Kingdom

[73] Assignee: Latchways Limited, United Kingdom

[21] Appl. No.: 08/809,807

[22] PCT Filed: Sep. 19, 1995

[86] PCT No.: PCT/GB95/02212

§ 371 Date: Mar. 18, 1997

§ 102(e) Date: Mar. 18, 1997

[87] PCT Pub. No.: WO96/09089

PCT Pub. Date: Mar. 28, 1996

[30] Foreign Application Priority Data

Sep. 19, 1994 [GB] United Kingdom ..... 9419129

[51] Int. Cl.[6] ..... A62B 1/14

[52] U.S. Cl. ..... 182/5; 182/192

[58] Field of Search ..... 182/5, 191–193; 188/65.2

[56] References Cited

U.S. PATENT DOCUMENTS 589,541 9/1897 Wilson ..... 182/192

4,265,179 5/1981 Tupper et al. .

5,029,669 7/1991 Lew ..... 182/193

FOREIGN PATENT DOCUMENTS 163563 12/1985 European Pat. Off. .

272782 6/1988 European Pat. Off. .

2044414 10/1980 United Kingdom .

WO 91/00121 1/1991 WIPO .

*Primary Examiner*—Alvin Chin-Shue

*Attorney, Agent, or Firm*—Klauber & Jackson

[57] ABSTRACT

A fall arrest device for use on an elongate safety line or track. The device contains a body part having retaining means to retain the safety line or track; locking cam means and biasing means for urging the locking cam means into locking engagement with the safety line or track in response to a sudden change in load experienced by the device; attaching means for attaching personnel safety means to the device; and cover means to receive loading applied to the device in a direction generally towards the safety line or track. The cover means are pivotally or rockably connected to the body part and are in a force transmitting relationship with the locking cam means thereby urging the locking cam means into locking engagement with the safety line or track.

9 Claims, 12 Drawing Sheets

FALL ARREST DEVICE

The present invention relates to fall arrest devices, and in particular to fall arrest devices for use on vertical or generally vertical safety cables or the like.

Fall arrest devices are an important feature for maintenance personnel who climb tall structures since they enable the hazard of falls to be eliminated.

In FIGS. 1 and 2 of European Patent Application No. 0 272 782, a self-locking fall arrest device is illustrated having a locking cam which is spring biased to a locking condition in which it firmly grips a safety line to lock the device to the safety line. In use, the device is connected to a lanyard of a personnel safety harness so that the loading applied to the locking cam by the lanyard is such as to maintain the locking cam in an unlocked condition, until such loading is released, for example in a fall arrest situation, whereupon the locking cam is then pivoted by its biasing spring to its locking condition.

Safety standards now require that the distance between the safety harness and the fall arrest device should be as short as possible. In some arrangements, the harness attachment can be at chest level and with a short connection to the fall arrest device, this device can be located at about the level of the stomach of the user.

This arrangement can present a problem in a situation in which substantial loading is then applied to the fall arrest device in a direction towards safety cable. This could occur, for example, if the fall arrest device became entangled in bulky clothing worn by the user and if the user leaned heavily towards the cable, perhaps in an unconscious condition.

The effect of a substantial weight applied to the device in such a situation, is that the body part becomes pressed against the cable before the locking cam is pivoted by its biasing spring to its locking condition. The force of the spring is insufficient to overcome the applied loading so that the device remains in an unlocked condition whereby the device is free to slide down the cable without providing the required fall arrest action.

The present invention seeks to provide a fall arrest device which is capable of minimizing the risk of ineffective locking action of the device when a loading is applied tending to force the device against a safety cable or the like with which it is engaged in use.

The invention provides a fall arrest device for use on an elongate safety line or track, said device comprising:

a body part having safety line retaining means to retain an elongate safety line or track whilst allowing movement of the body part therealong;

locking cam means for locking the device to said elongate safety line or track in a fall arrest situation;

biasing means to urge said locking cam means into locking engagement with a safety line or track accommodated in the safety line retaining means in response to a sudden change in load experienced by the device, and means for attaching personnel safety means to the device;

characterised in that the device further comprises cover means on the side of the body part on which said attaching means are situated, to receive loading applied to the device in a direction generally towards an elongate safety line or track engaged in the device in use, said cover means being pivotally or rockably connected to the body part and being in a force transmitting relationship with said locking cam means to apply said loading to said locking cam means so as to urge the locking cam means into locking engagement with a safety line or track accommodated, in use, in the safety line retaining means.

The addition of the cover means which, when loaded towards the safety wire, will by the nature of its construction, override any direct loading against the locking cam means that prevents locking operation thereof, but rather applies the loading to the locking cam means to urge it into its locking condition.

According to a feature of the invention, the locking cam means may comprise a pivotally mounted cam member having a grip portion formed on a part thereof for making said locking engagement with said elongate safety line or track. The attaching means may conveniently be provided on the cam member on the opposite side of the pivotal axis thereof to said grip portion.

In embodiments of the invention for use on safety cables or tracks having intermediate support brackets, the device may include at least one rotary member having at least one recess formed in its periphery, the rotary member being rotatably mounted in relation to said retaining means. The recess is adapted to traverse support means used to support an elongate safety line or track without the need for user manipulation by rotation of the rotary member relative to the retaining means such that elements of the support means are received, guided and passed by the recess automatically.

In such embodiments, the rotary member may be a wheel having a plurality of petals projecting radially from the hub of the wheel, said petals defining between adjacent pairs thereof recesses for traversing safety line support means.

Moreover, said retaining means may include at least one slipper element for slidable engaging a safety line or track and mart co-operate with the wheel such that the wheel can rotate with respect to the slipper element whilst traversing safety line support means.

According to another feature of the invention, the cover means may have a thrust transmitting part in direct contact with said locking cam means.

According to a further feature of the invention, the cover means may transmit said loading to said locking cam means through an intermediate link movably mounted on said body part.

In some constructions in accordance with the invention, the cover means may comprise a generally U-shaped elongate member which is pivoted adjacent one free end thereof to said body part and which, adjacent its other free end, is in direct or indirect load transmitting relationship with said locking cam means.

In other constructions in accordance with the present invention, the cover means may be adapted to enclose said portion of the body part and parts of the locking cam means projecting from the side edge of the body remote from an elongate safety line or track accommodated, in use, in the safety line retaining means.

According to a preferred feature of the invention, said body part may have a contact portion which is spaced from said locking cam means and has contact means for engaging a safety line or track which, in use, is retained by said safety line retaining means wherein said cover means is preferably pivotally or rockably connected to said body part in the region of said contact portion of said body part.

Embodiments of the invention will now be described by way of example only with reference to the drawings, in which.

Figure 9:
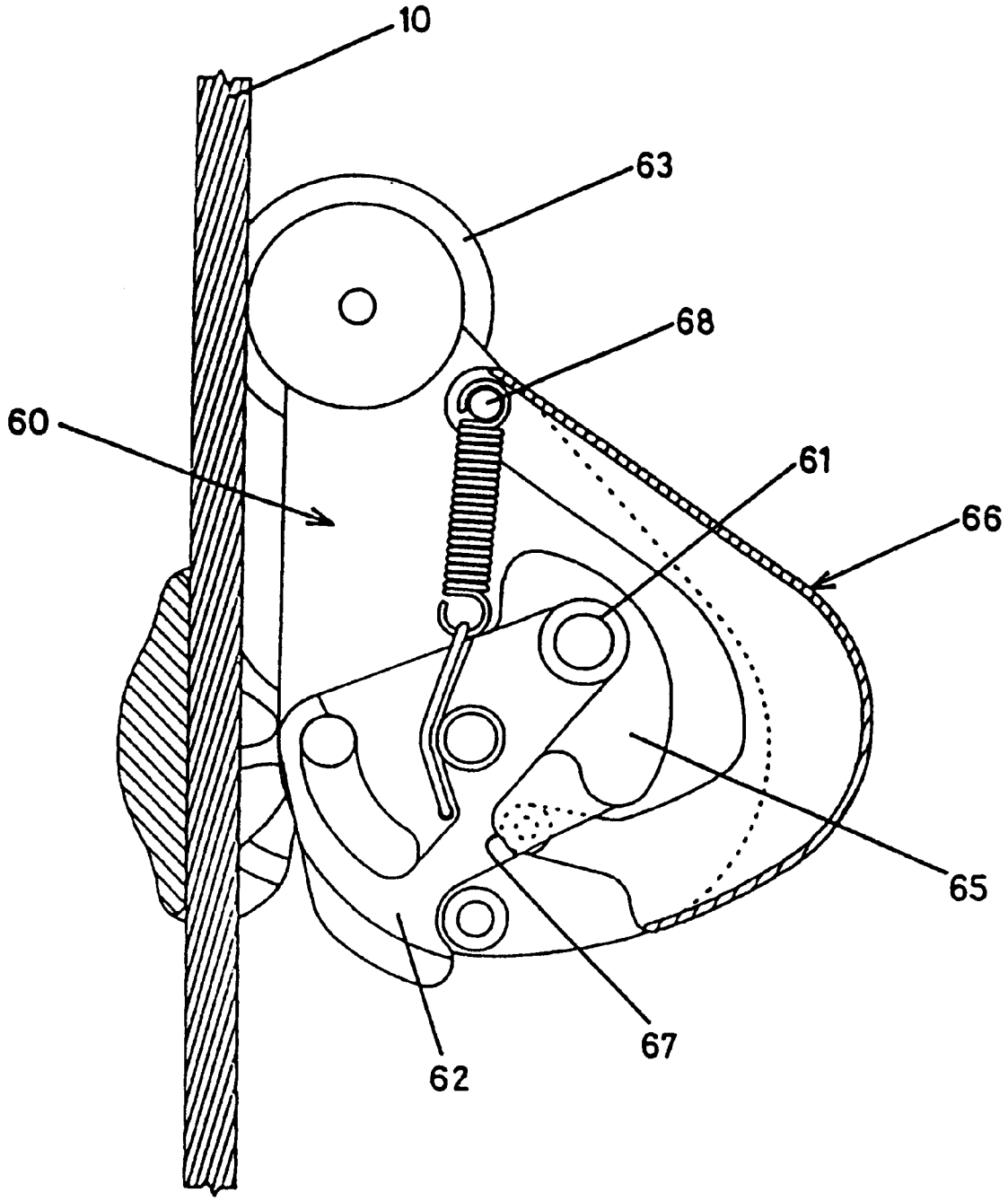
FIGS. 9 and 10 are vertical sections through a third embodiment in the unlocked and locked conditions thereof.
Figure 10:
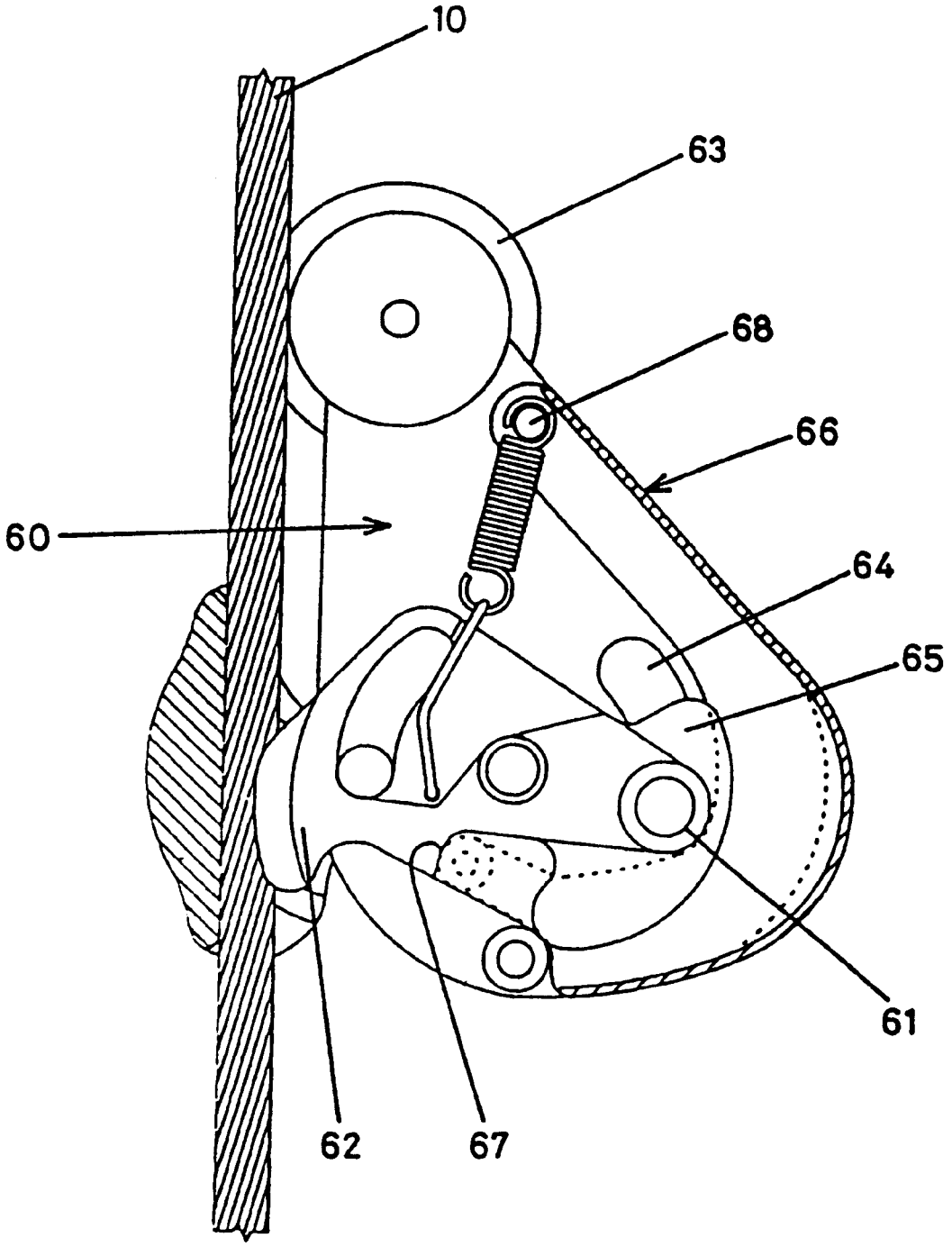
Figure 11:
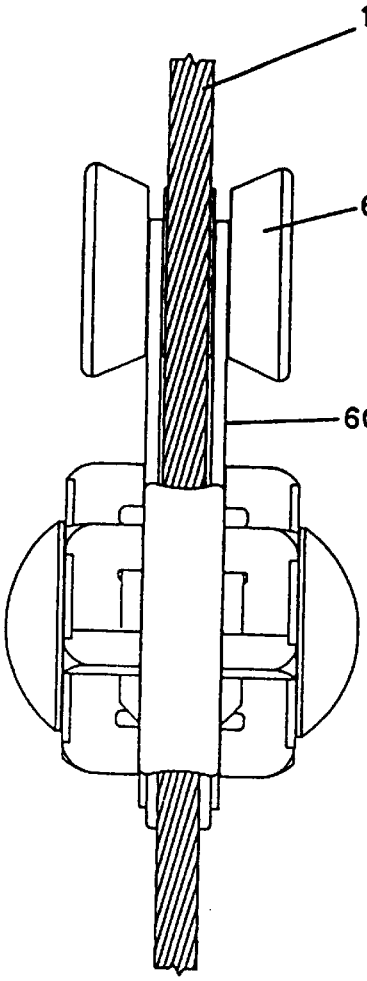
Figure 12:
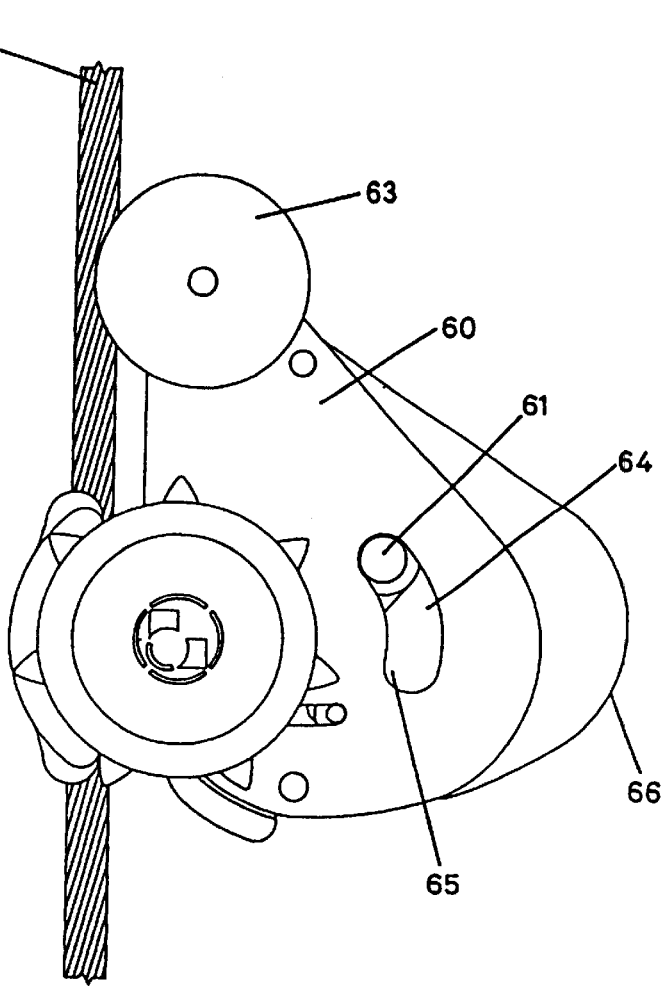
Figure 13:
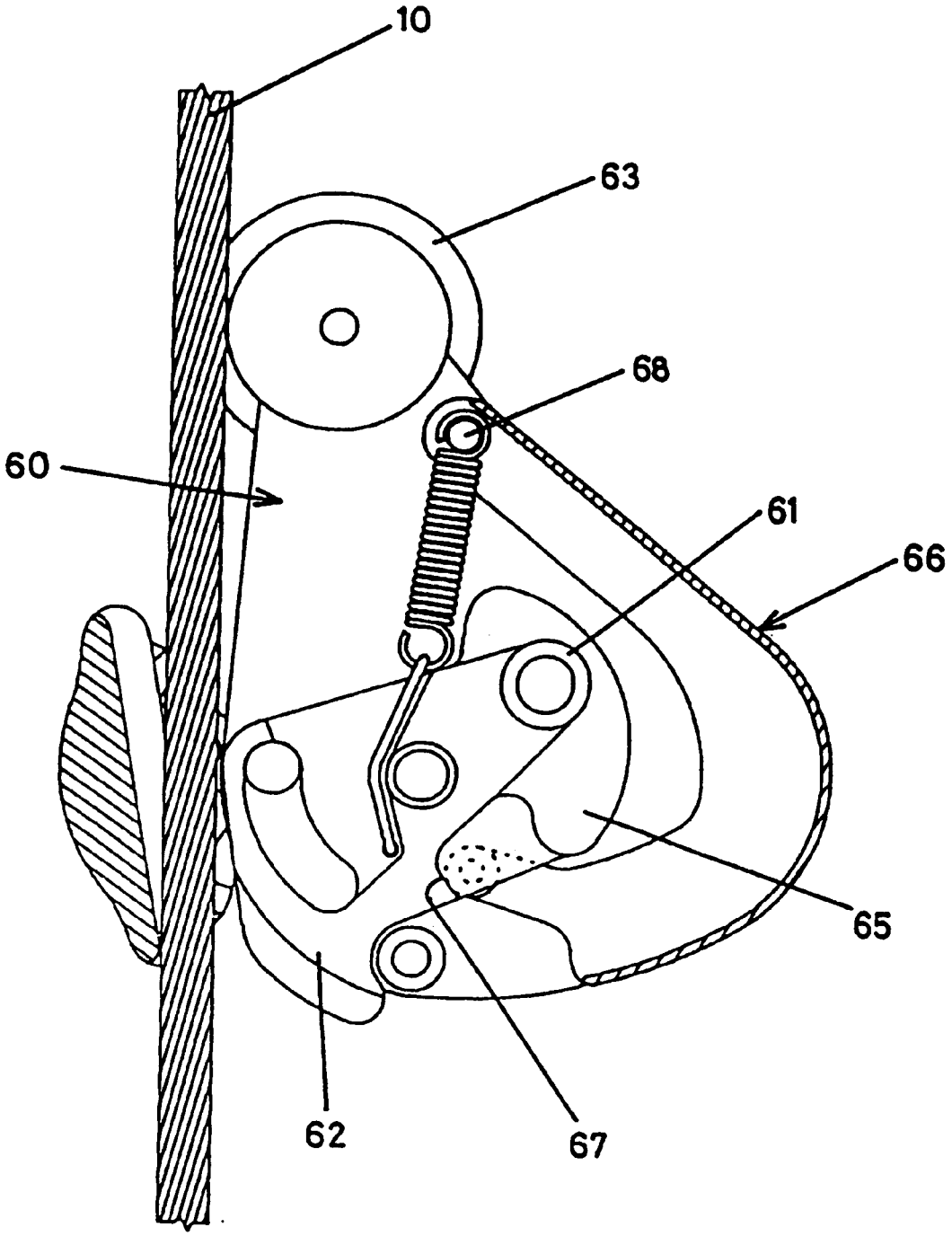
Figure 14:
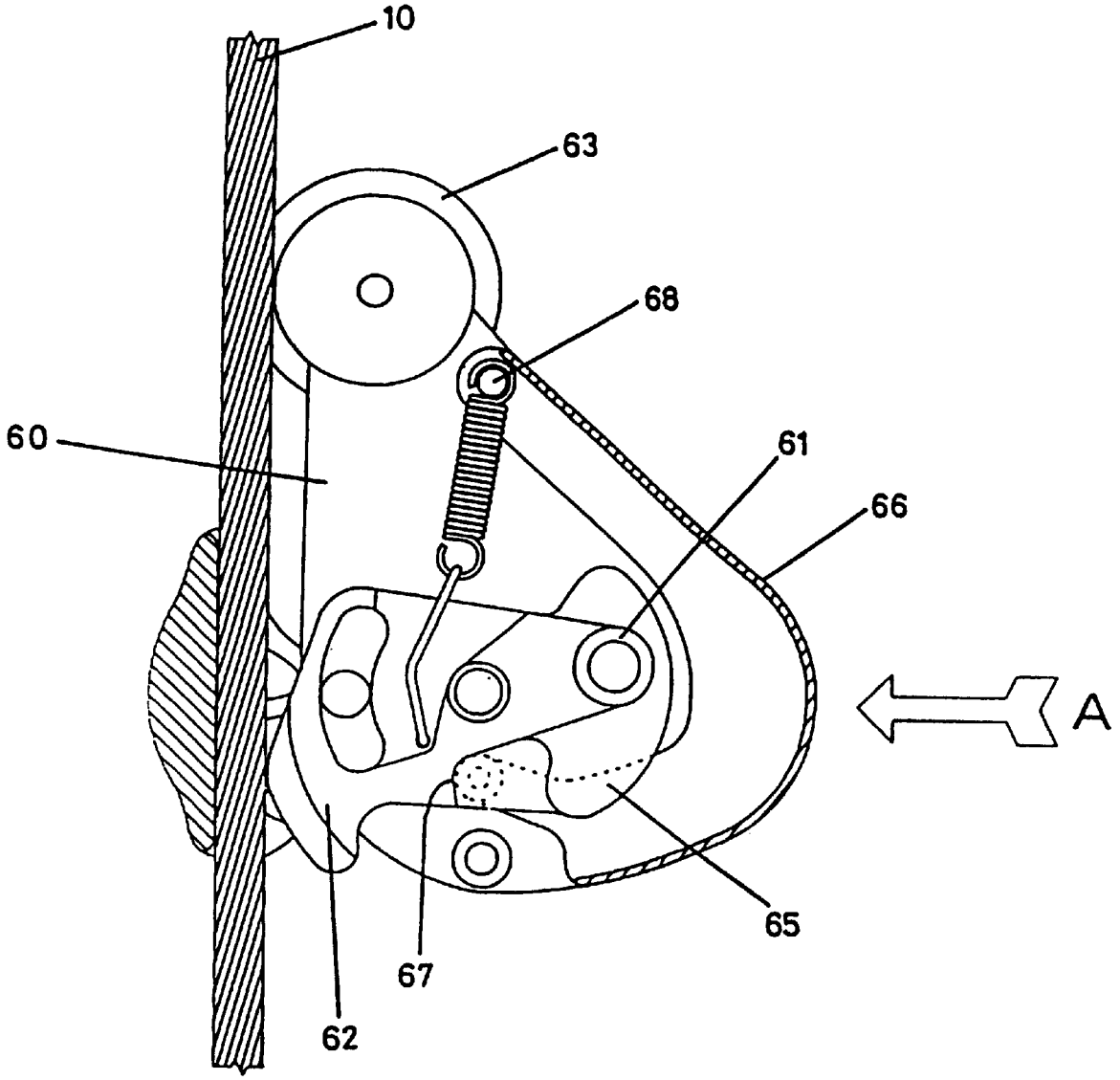

FIGS. 11 and 12 are an end view and a side view of the device of FIGS. 9 and 10; and FIGS. 13 and 14 are vertical sections corresponding to FIGS. 9 and 10 but showing practical operation thereof under applied loading conditions.

Referring now to FIGS. 1 to 4, there is illustrated a fall arrest device according to the invention for use on a single span vertical safety wire or rod (10), i.e., a wire or rod having no intermediate supports.

The device comprises a U-shaped body part (11) which envelopes the safety wire or rod (10). A pair of rollers (12) rotatably provided with the body part (11) run on opposite sides of the wire or rod (10). A rotary locking cam (13) is pivotally mounted within the body part on a pin (14). The cam (13) has an eye (15) at one end through which a shackle (not shown) for attachment of a safety harness, is clipped. The cam is biassed by spring (16) to its locked condition, as shown in FIGS. 1 and 3, in which a grip portion (17) bites into the cable (10).

Figure 2:
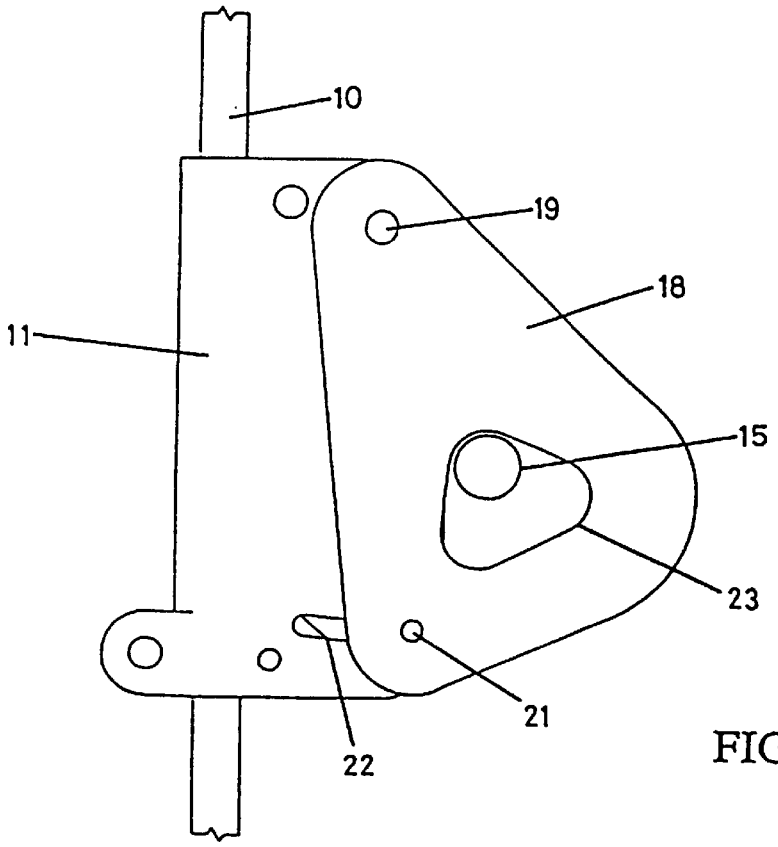
Figure 4:
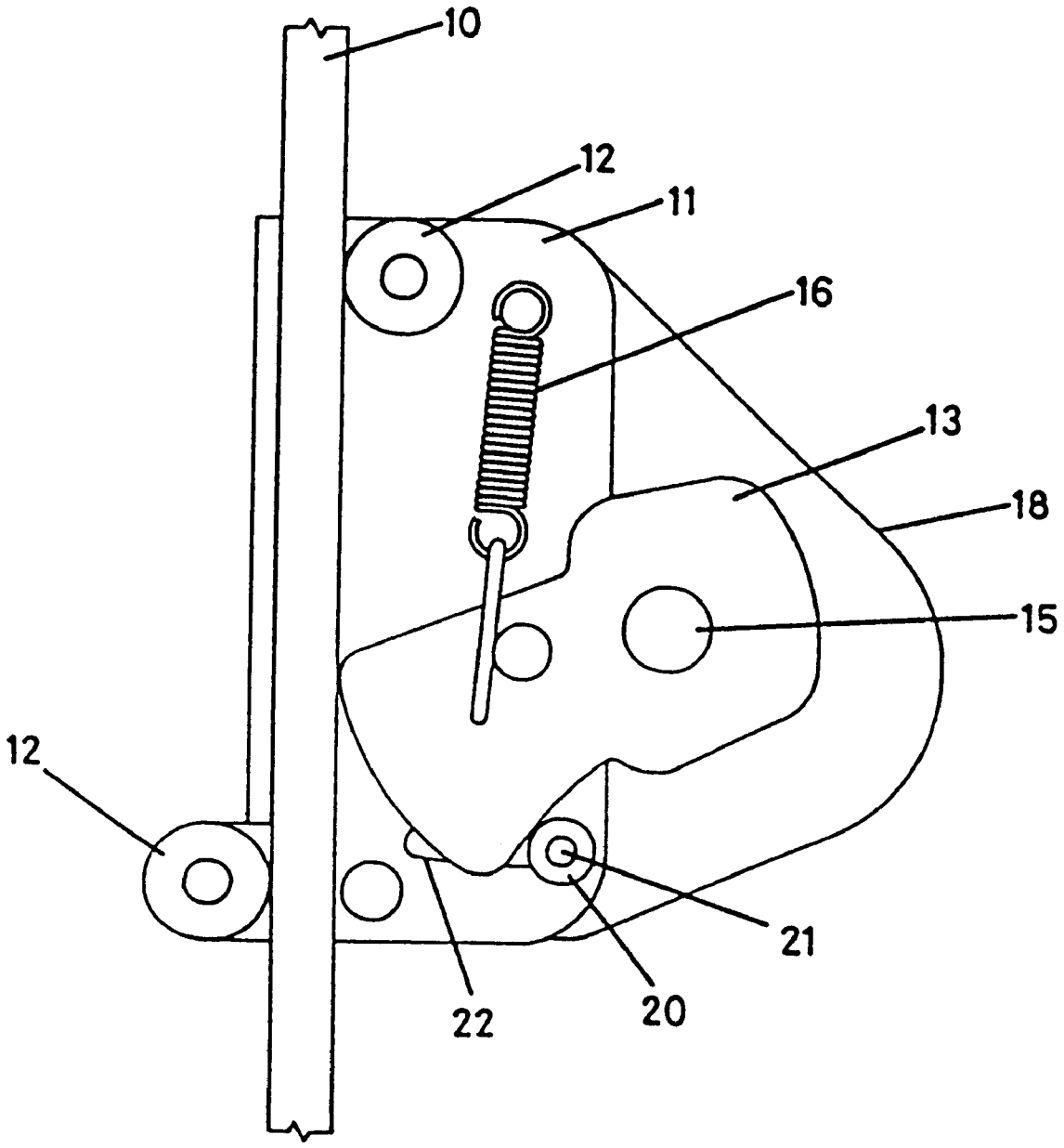

In normal operation, the cam (13) is held in its unlocked condition, as shown in FIGS. 2 and 4, in which the loading applied to the cam at the eye (15), by the person attached to the device, rotates the cam (13) against the force of the spring (16). In such condition the device is freely movable up and down the cable (10).

Figure 1:
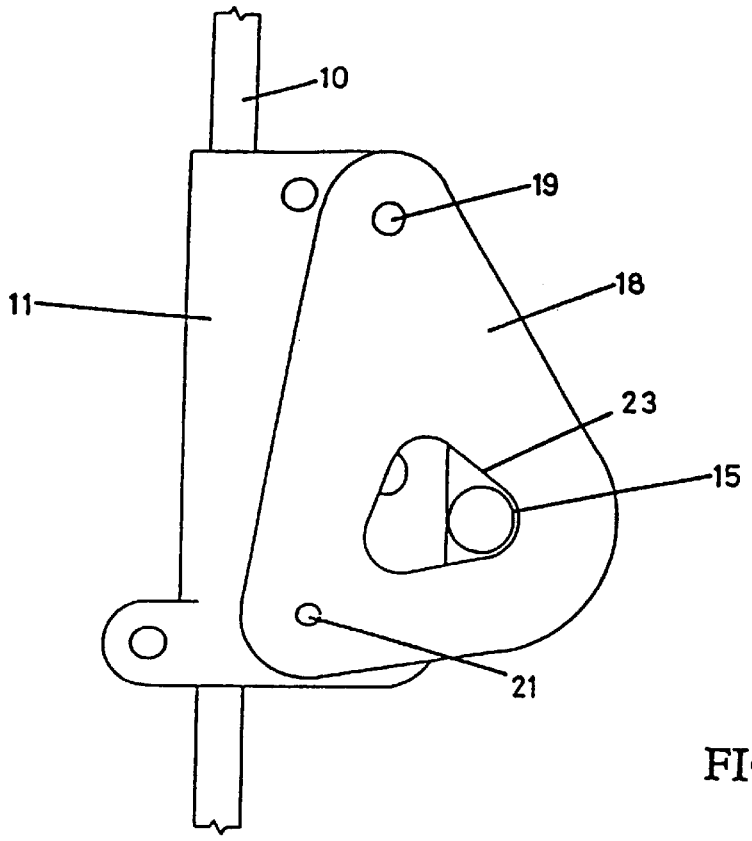
FIGS. 1 and 2 are side views of a first embodiment of the invention illustrating locked and unlocked conditions thereof, respectively.
Figure 3:
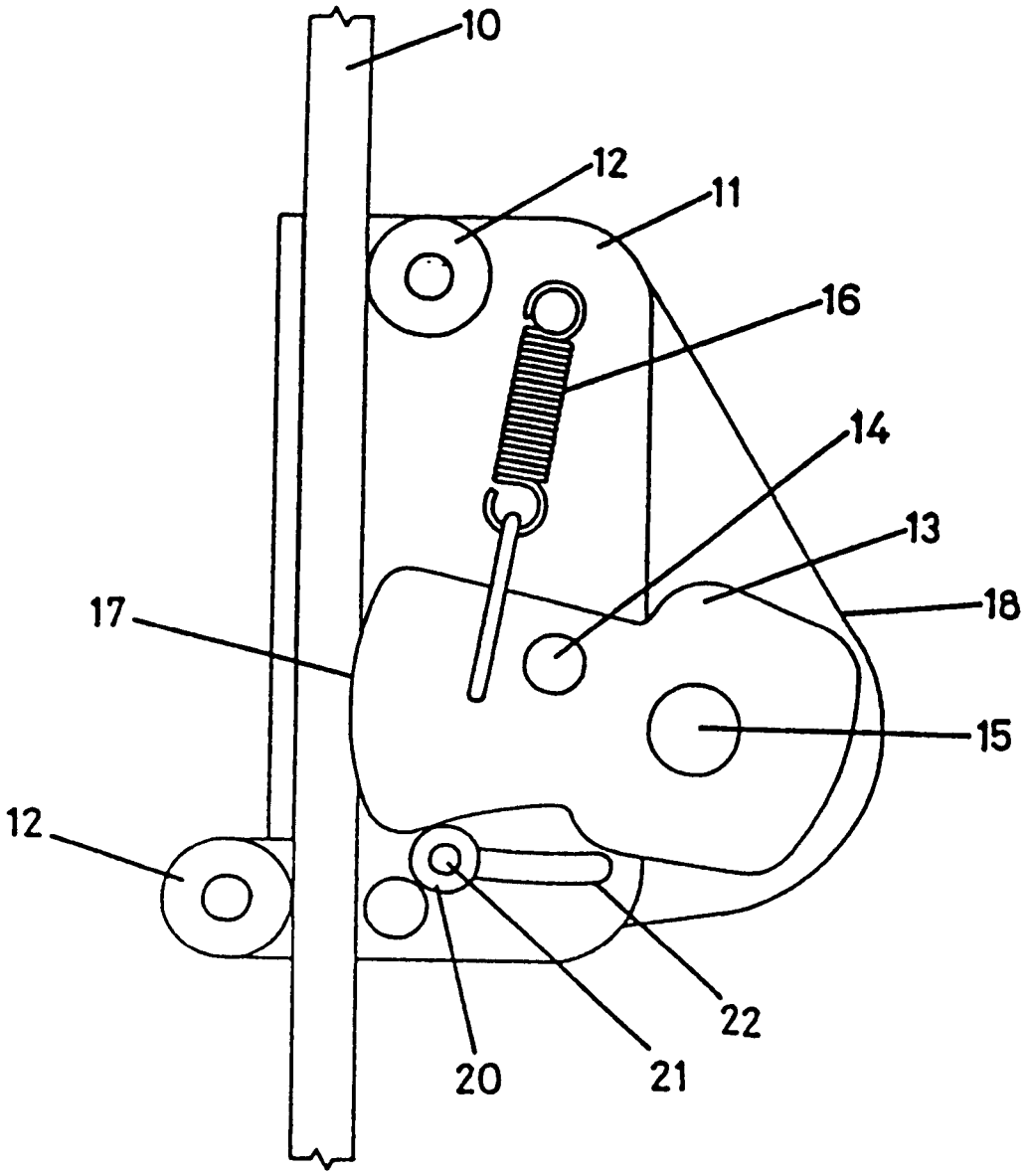
FIGS. 3 and 4 are vertical sections through the device of FIGS. 1 and 2 in the locked and unlocked conditions thereof.

In a fall arrest situation, the loading at the eye (15) is released so that the locking cam (13) is rotated by the spring (16) to its locked condition, as shown in FIGS. 1 and 3, in order to arrest the fall of the person attached to the device.

In accordance with the invention, the device is provided with a pivotally mounted cover (18) which acts to ensure proper locking operation of the cam (13) when a substantial force is applied to the device in a direction towards the cable (10). Such a condition can occur if the person secured to the device leans against the device in operation. This is more likely to occur when a relatively short connection is provided between the device and the user's safety harness attached to it. In such circumstances, the tendency is to force the leading edge of the cam against the cable (10) with such a force that prevents the spring (16) from rotating the cam to its locking condition as illustrated in FIG. 3, so that the device is not firmly locked to the cable (10) and cannot properly arrest a potential fall of the user.

The cover (18) is in the form of a hollow bulbous shroud which protrudes from the side edge of the body part (11) remote from the cable (10) and encloses the projecting eye section of the cam (13), whereby any loading applied to the device towards the cable (10) is borne by the cover (18).

The cover (18) is pivoted to the body part (11) about a pin (19) provided at an upper part thereof near to the position of the upper roller (12). A roller (20) is provided within the cover (11) at a lower end thereof and is mounted on a pin (21) extending between the side walls of the cover. Pin (21) extends through arcuate slots (22) formed in the side walls of the body part (11).

The roller (20) acts on the heel of the cam (13) such that, when loading is applied to the cover (18), in a direction towards the cable (10), the cover (18) pivots about pin (19) to apply the loading directly to the cam (13) causing it to move to its loaded condition as shown in FIG. 3. This substantial loading applied directly to the cam (13) ensures locking of the device, whereas the force of spring (16) alone would be insufficient to achieve this locking condition of the cam, if the loading was applied to the protruding eye section (15) of the cam (13) and/or the body part (11). It will be appreciated that the arrangement is such that the first contact with the device in the direction towards the cable (10), is with the cover (18) to ensure proper locking of the device, without contacting any other part of the device.

Cut-out sections (23) are provided in the side walls of the cover (18) to allow an attachment shackle to be engaged in the eye (15) of the cam (13). Moreover, although in the embodiment shown the cover (18) is located externally of the body part (11), it could, in other embodiments, be mounted internally thereof.

FIGS. 5 to 8 illustrate a second embodiment for use on a cable having a number of intermediate supports which can be traversed by the fall arrest device without detachment of the device from the cable. The basic construction and operation of the fall arrest device are the same as described and shown in FIGS. 1 and 2 of European Patent Application No. 0 272 782.

The fall arrest device is engaged with a vertical or near vertical safety wire (10). The device is so adapted that it can traverse locating hanger members which are engaged with the wire (10) at spaced locations therealong, without the device having to be disengaged from the wire. Such hangers may be in the form of U-shaped elements for engaging around the wire and having attachment means for securing to a fixed structure.

The fall arrest device comprises a load-transfer device of the general type described in British Patent Specification No. 1 582 201 and corresponding U.S. Pat. No. 4,265,179 for engagement with an elongate element for movement therealong, whilst permitting the device to traverse intermediate support points of the elongate member without being detached therefrom. The device comprises a pair of spaced apart wheel elements (30,31) with a slipper member (32) being located between the wheels at a peripheral portion thereof. Each wheel (30,31) is formed with 7 radially projecting portions (33) which define therebetween 7 equiangularly spaced recesses in the periphery of the wheel. The wheels are rotatably mounted on an axle (34). Each wheel is provided with a metal disc (35), e.g., made of steel, located against an end face of the associated wheel which is remote from the other wheel to extend partway along each recess defined in the periphery of the wheels These discs (35), which are superficially mounted with resilient buffer elements (36), inhibit engagement of the wire (10) in one of the recesses defined in the wheels so as to prevent "winding-out" of the wire (10) from the load transfer device on rotation of the wheel relative to the slipper member (32). Without the disc and buffer members, such engagement of the wire (10) in a recess in one of the wheels followed by subsequent rotation of the wheel relative to the slipper member could result in complete detachment of the device from the wire (10).

The slipper member (32), positioned between the wheels at the peripheries thereof, has a pair of axially projecting, arcuate flanges (not shown) which engage in correspondingly shaped grooves (37) formed in the inner confronting surfaces of the projecting parts (33,) of the wheels, thereby to locate the slipper member (32) in position between the wheels whilst allowing the wheels to rotate complete revolutions in either direction with respect to the slipper member.

In this way, U-shaped hanger elements which contain the wire (10) can be received in a pair of corresponding recesses in the wheels and can pass through the device in such recesses as the wheels then rotate relative to the slipper member (32) with the parallel arms of the hanger element embracing the slipper member (32). In this way the device can move up and down the wire (10) past locating hanger elements therefor without being detached from the wire.

The device further comprises a locking assembly (38) which is located in the space between the wheels (30,31) to project radially therefrom. The locking assembly (38) comprises a pair of elongate side plate members which are fixed to one another in a spaced apart relationship by a pair of shouldered spacer pins to form the body part (39) of the device. A locking cam member (40) is pivotally mounted between the side plates of the body part (39). The cam (40) has a pair of axially aligned circular bosses (41) projecting one on each side thereof, in the manner of a pair of trunnions, for engagement in corresponding holes provided in the side plates of the body part. The locking cam (40) is therefore pivotally mounted between the side plates of the body part about the axis of the bosses (41).

Figure 6:
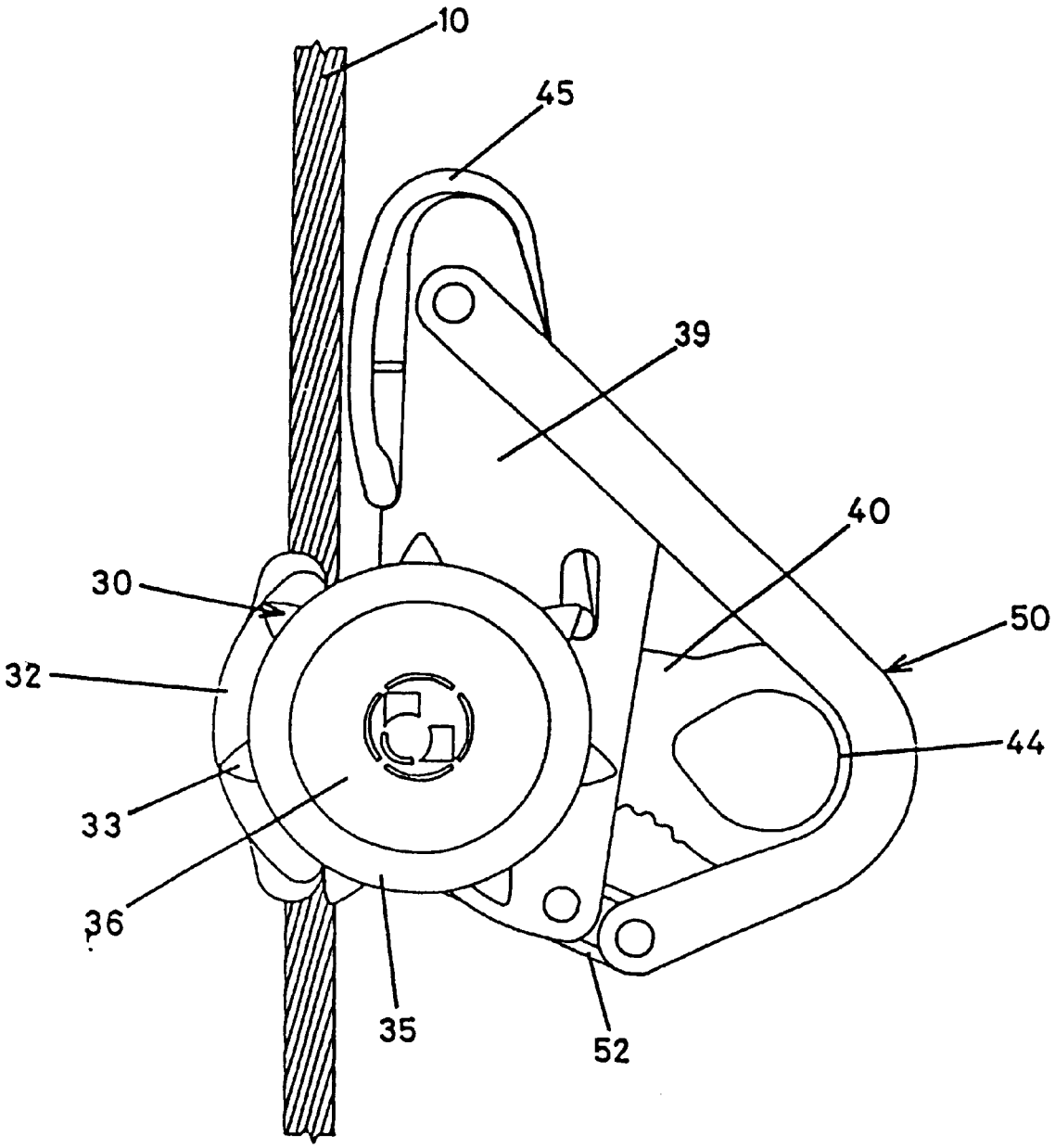
Figure 8:
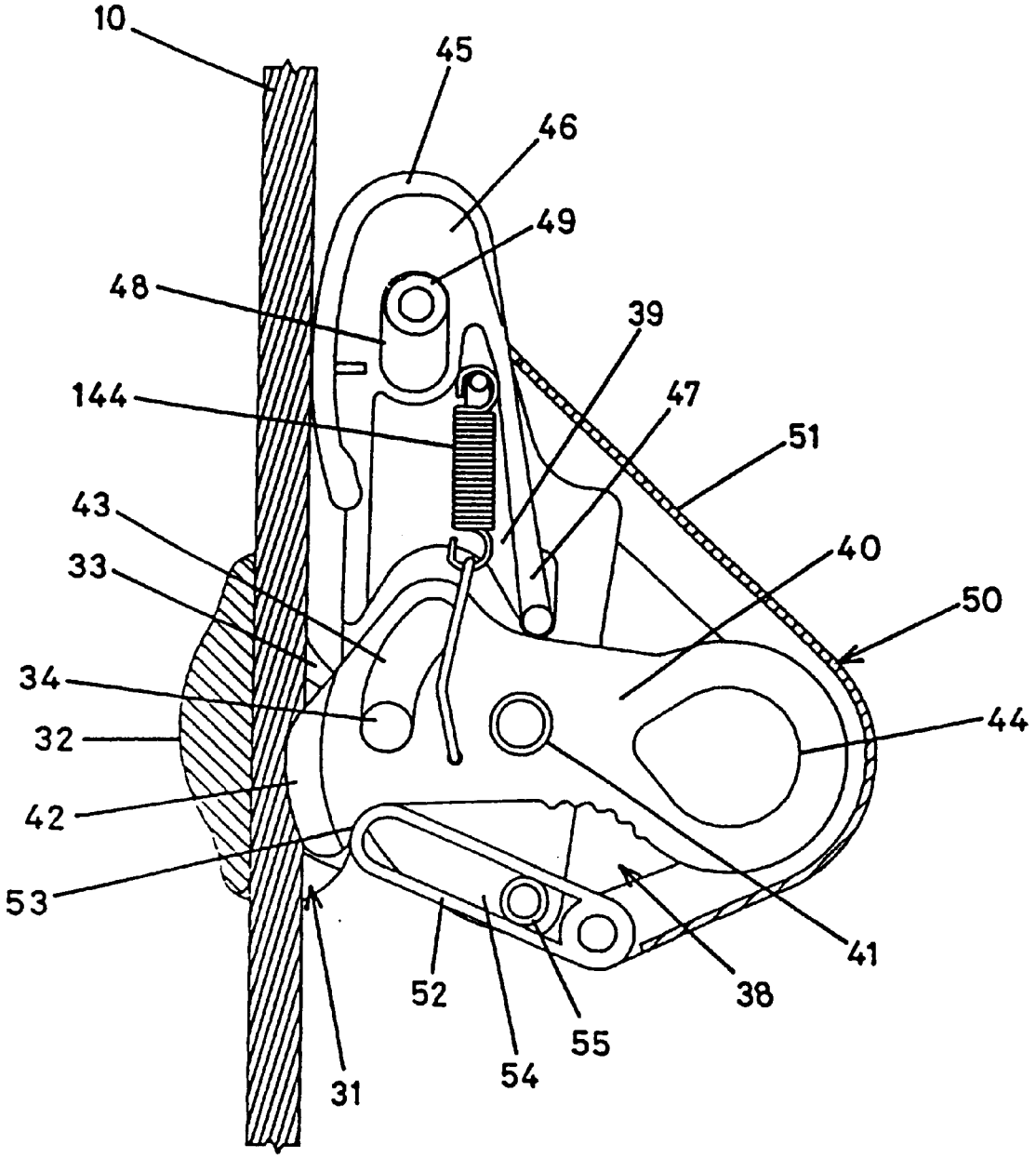

The cam member is formed with a gripping edge formation (42) for acting on the wire (10) so that it is firmly gripped between the cam formation (42) and an opposed arcuate surface in the slipper member (32) which receives the wire (10), when the cam is in its locking position as shown in FIGS. 6 and 8. The cam is also formed with an aperture or eye (44) for receiving a safety hook device provided, for example, at the end of a lanyard attached to a safety harness. The locking cam (40) is further formed with an arcuate slot (43) through which the axle (34) of the load-transfer device extends. A tension spring (144) is provided to act between the locking cam and the side plates of the body part (39) to normally bias the locking cam member into its locking position as shown in FIGS. 6 and 8.

The locking assembly (38) further comprises a slider member (46) made for example of a plastics material such as Nylon. Slider member (46) has a flat body part located between and generally conforming to upper portions of the side plates of the body part (39). The slider member is formed with a rounded thickened section (45) at its upper periphery and side portions adjacent thereto to provide a sliding portion which engages the wire (10). The slider member is further formed with a downwardly projecting finger (47) which engages the locking cam (40) for acting thereof in an emergency situation as described below. The body part of the slider member (46) is formed with an elongate slot (48) through which an upper shouldered spacer (49) of the side plates of the body part (39), extends. This arrangement allows a vertical sliding movement of the slider member (46) with respect to the side plates of the body part.

Figure 5:
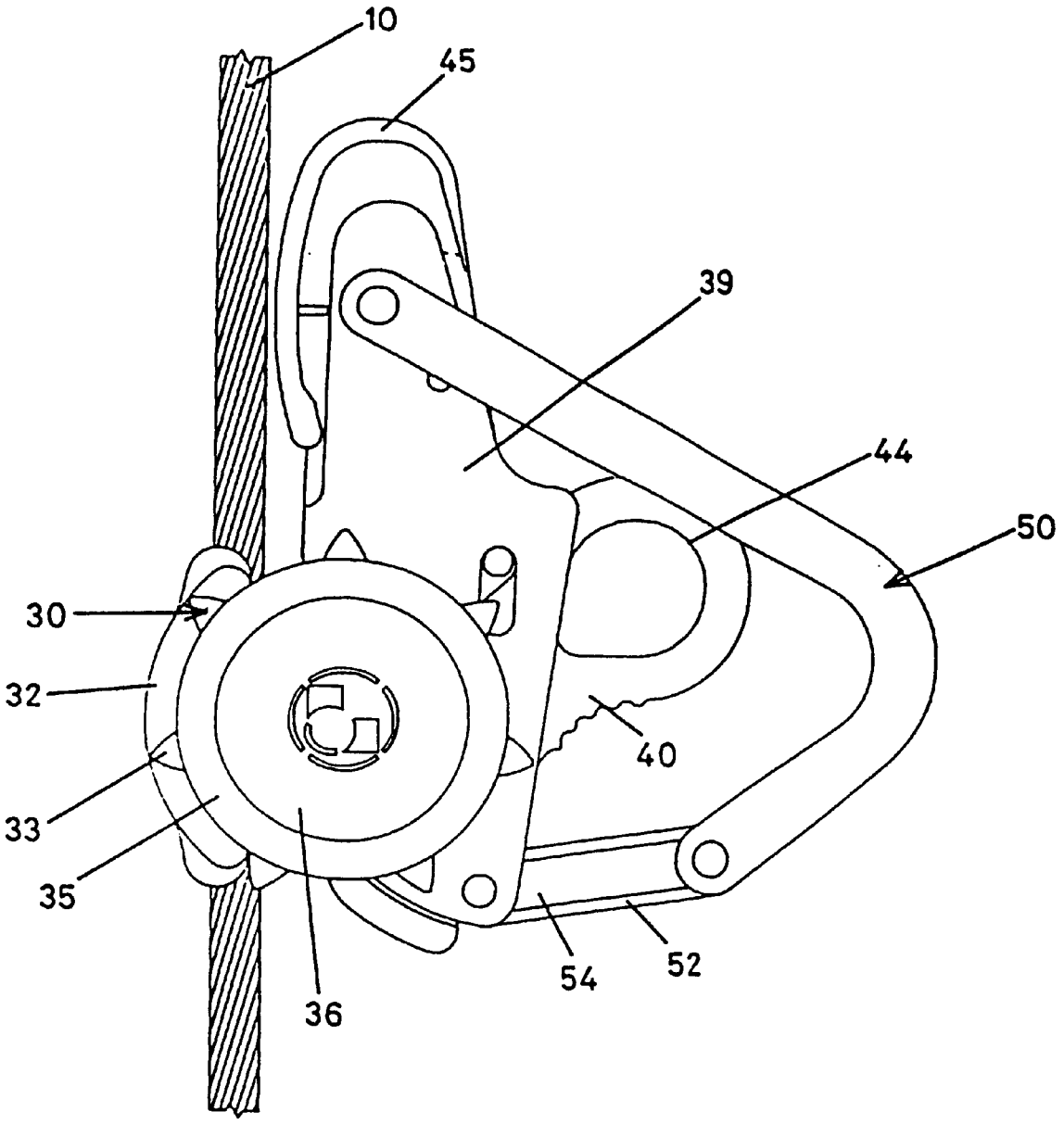
FIGS. 5 and 6 are side views of a second embodiment illustrating locked and unlocked conditions thereof, respectively.
Figure 7:
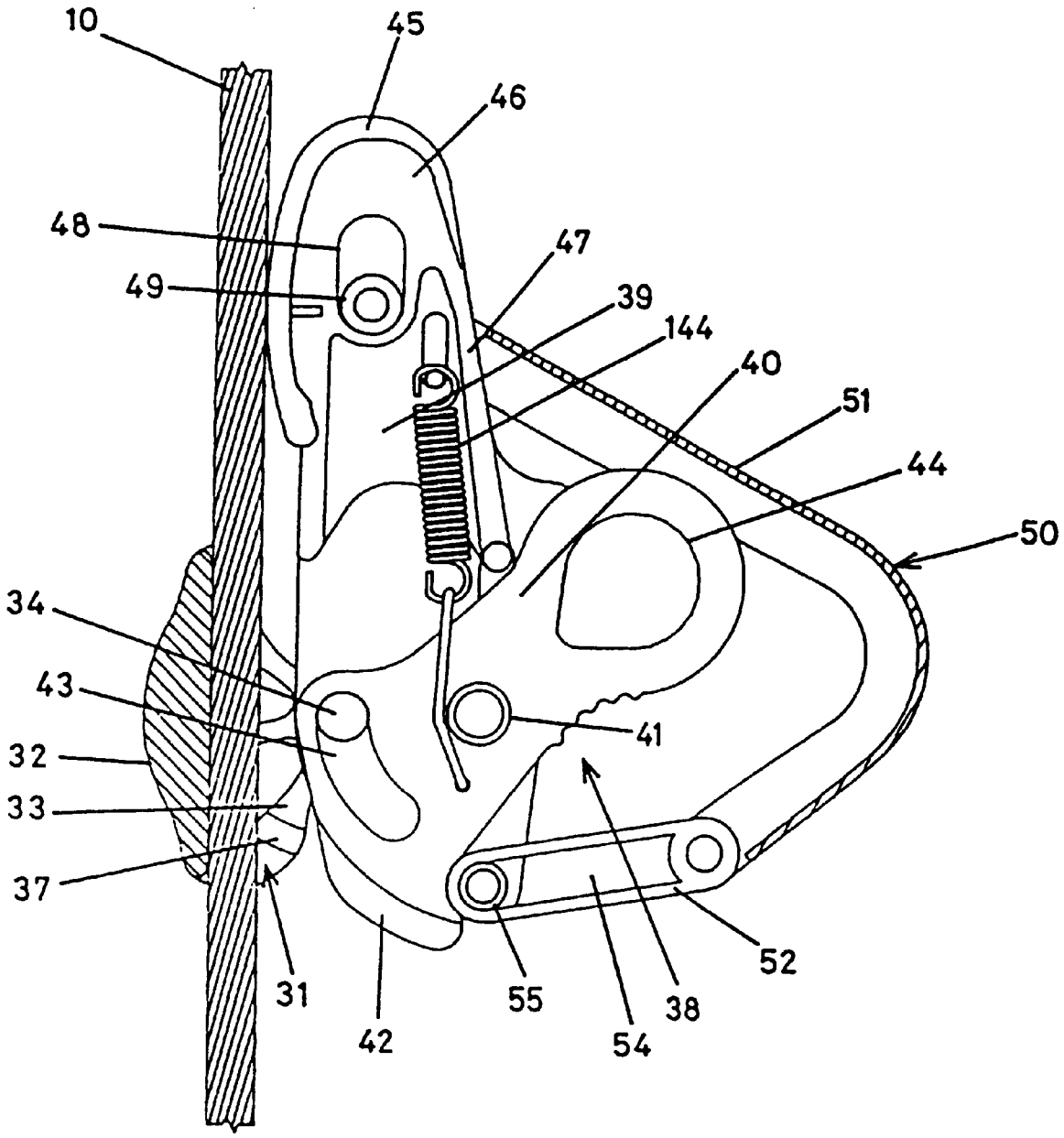
FIGS. 7 and 8 are vertical sections through the device of FIGS. 5 and 6 in the locked and unlocked conditions thereof.

FIGS. 5 and 7 show the positioning of the locking cam member (40) when a generally upwardly directed load is applied thereto, for example by the connection of a lanyard hook to the eye (44) of i:he locking cam member (40). Such a load will be applied to the device when a person connected thereto is ascending or descending when the fall arrest device will move slidingly up or down the safety wire (10). The device will be "pulled" up the wire (10) when the person secured thereto is climbing, or will drop down the wire (10) under its own weight when the person is descending, whereby tension will be maintained in the securing lanyard thereby maintaining the locking cam member (40) in the position shown in FIGS. 5 and 7 such that it does not cause jamming of the wire (10) against the slipper member (32). The slider member (46) is moved to its uppermost position with respect to the side plates of the body part and its rounded enlarged portion (45) slidingly engages against the wire (10). In such a condition, intermediate support hangers for the wire (10) can be traversed, first by engagement with the slider member (46) which is moved away from the wire (10) sufficiently to allow the hanger to pass and then by engagement of the hanger member in a pair of corresponding recesses in the wheels (30,31) to be moved through the load-transfer device as the wheels then rotate relative to the slipper member (32). During such traversing operations, the load-transfer device remains connected to the wire (10).

When the upwardly directed load on the locking cam (40) is relieved by the removal of tension in the lanyard, the biasing spring (144) then causes the locking cam (40) to move to the position shown in FIGS. 6 and 8 whereby the gripping portion (42) of the cam digs into the wire (10) thereby jamming it against the opposed surface of the slipper member (32) and effecting locking of the device to the wire (10). Therefore as soon as tension is relieved in the lanyard, the device is automatically brought into a locked condition. Any loading applied to the locking cam in a generally downward direction, for example applied through the lanyard attached to cl person thrown outwardly away from the device or slipping vertically downwards, will merely enhance the jamming effect of the wire between locking cam (40) and the slipper member (32) to provide a secure fall arrest facility.

The slider member (46) provides an additional safety feature in that it can be manually pressed downwardly to act on the locking member (40) through its downwardly projecting finger (47) causing the locking member to be brought firmly into its locked condition. Therefore if a person grabs hold of the fall arrest device in an emergency, it is most likely to cause the downward movement of the slider member (46) from the position shown in FIGS. 5 and 7 to the position shown in FIGS. 6 and 8 which causes the device to become locked to the wire (10).

The pivotal location of the locking cam (40) is such as to enhance the locking action of the device. The pivotal axis of the locking cam provided by spigots (41), is considerably nearer the eye portion (44) of the cam then the wire (10). First, this construction gives greater movements for the locking portion (42) of the cam (40) for relatively small movements of the eye portion (44) thereby increasing the sensitivity of the locking action of the cam (40) with respect to movements of the eye portion (44) thereof. Secondly by having the pivotal axis of the locking cam remote from the wire (10) it is possible to increase the leverage of the gripping portion (42) of the cam when it bites into the wire (10). Thirdly, when a downward load is applied to the eye portion (44) of the locking cam in a fall arrest situation, there is a mechanical advantage of about 3:1 in respect of the application of this load at the gripping portion (42) of the locking cam.

It will also be appreciated that when the locking assembly (38) is brought into the locked condition as shown in FIGS. 6 and 8, the locking assembly (38) rotates about the axle (34) of the load-transfer device under the action of tension spring (144) and its own weight which further assists in maintaining the locking cam in its locked condition.

In accordance with the invention, the fall arrest device is provided with a cover (50) which is shaped to protrude over the part of the cam (40) which projects from the body part (39). It is in the form of a generally U-shaped elongate strip (51) having a channel cross-section. In other embodiments, the cover could be shaped from a wider flat strip. A longer, upper leg of the cover (50) is hinged to the body part (39)

at the upper end thereof, to allow the shorter, lower leg of the cover (50) to move towards and away from the body part (39). At this lower position, a second intermediate link member (52), is pivoted to the cover (50) and engages in a notch or a recess (53) in the cam lobe. The link member (52) is so shaped that it is guided along part of its length by a slot (54) therein which receives a pin (55) fixed between the side walls of the body part (39), in order to control the path of travel of the intermediate link (52). The slot (54) can be angled so as to give optimum leverage to the cam lobe as the cover acts through its working range.

The cover element (50) is free to move independently of the cam (40), so that the cam (40) can also operate freely within the cover (50) to achieve a fall arrest operation under the action of biasing spring (144) in normal operation conditions. When the cam (40) is moved into its unlocked condition, as shown in FIGS. 5 and 7, the cover (50) is held away from the body part (39). However, when a load or pressure is exerted against the cover (50), towards the cable (10), the cover acts to apply the loading to the cam (40) to ensure proper locking operation of the cam. It is possible for the cover (50) also to be biased to close by a spring, in the same way that the cam is biased by a spring.

When the device is in use it will normally be attached to the user by a short link and or very short lanyard. The device assumes an open position, hanging in effect from the user. The cover (50) at this moment is held away from the body (39) of the unit by the cam (40). The weight of the device "holds" the cam in the open position. If the operative stumbles or falls the cam lever will tend to rotate around its pivot, assisted by the spring tension and allow the cam lobe to lock. If the user is so positioned that his clothing or body puts a partial load or pressure on the device, it would be at this time that the cover, protruding towards the user, should be the first contact to the user and follow its locking sequence. Even if the forces are quite high, the cover by its mechanical leverage ensures the cam will not be held open.

In this embodiment the cover (50) is sic shaped to allow maximum freedom to karabiner type links and hooks.

It is important to recognize that this action, a pushing towards the wire (10), does not resist rotation of the cam (40), as pressure on any part of the device would induce. This action is possible because of the contact of the wire (10) at the slipper pad position (45), this being the fulcrum to the subsequent rotation. The cam lobe or face (42) is the other contact position to the wire (10). The lobe follows its intended rotation around the cam pivot position.

It is a mechanical function that overrides the natural tendency for the cam to lay flat against the wire when pressure is applied to the body (39) of the device or at the cam lever connecting eye (44), when exposed, without a protective cover.

The fall arrest device illustrated in FIGS. 9 to 14 is generally similar in basic construction and operation to the device of FIGS. 5 to 8. In this construction, the body part (60) is shaped such that the attachment eye section (61) of the cam (62) does not project outwardly thereof and the slider member (46) at the upper end of the body part is replaced by a grooved roller (63) which runs on the cable (10). The side walls of the body part (60) have arcuate slots (64) formed therein to enable an attachment shackle to be engaged with the eye (61) in the cam (62). The cam (62) is formed with an arcuate flange (65) which projects on opposite sides of the attachment eye (61) to mask the parts of the slots (64) not aligned with the attachment eye (61) to prevent the device from being held in its unlocked condition by a wrong connection of an attachment shackle or a pin or other member being jammed in the slots (64).

The cover (66) is so shaped that the intermediate link of the embodiment of FIGS. 5 to 8 is not used. The bottom end of the cover (66) is engaged directly with the cam (62) at a suitable position to give a similar leverage to the embodiment of FIGS. 5 to 8, namely in a recess (67) formed in a side flank of the cam (62). The engagement end of the cover (66) in the recess (67) may be provided with a roller to reduce friction. Similar functions are incorporated to allow freedom of operation, the cam (62) being partially free to rotate independently of the cover (66).

FIGS. 13 and 14 illustrate the way the device can be influenced by a load applied to its body part (60). FIG. 13 shows the situation where the device is pushed against the cable (10) with the cam (62) still in its unlocked condition. The cam (62) requires a mechanical leverage to move the body part (60) away from the cable (10) to allow the cam (62) to move to its locked condition. FIG. 14 shows the effect of applying pressure to the cover in the direction of the arrow (A) and the subsequent locking up of the device. This pressure acts to pivot the cover (66) about pin (68) so that the lower end of the cover (66) acts on the cam (62) with sufficient force to pivot the body part (60) away from the cable (10) about the axis of the contact roller (63) as the cam is rotated into its locked condition, as illustrated in FIG. 14.

Without the above-described action of the cover (66), the device could remain open until the loading applied towards the cable (10) is reduced or removed.

It can be seen from this embodiment that the roller (63) at the upper end of the body part (60), can assist smoothness of operation and reduce wear. This is, however, not essential to the successful working of the device and a slider member, by its contact with the cable (10), also acts as a support to the pivotal action of the cover (66).

Rotation is assisted by the friction generated at the cam lobe position as it contacts the wire. The friction is amplified by the pressure generated by the mechanical leverage and a negative moment of rotation caused by opposing forces against the cam. The protective cover can be envisaged to act in a direct way to the cam, as illustrated in FIGS. 13 and 14. The projecting lower end of the cover interacts with a recess position in the cam, that again gives a moment of leverage which gives a mechanical advantage over any opposing forces. Thus a rotation is possible and the body will move towards and/or in the direction that is opposite to the applied load.

The shape of the protective cover is such that it clearly protrudes outside other parts of the chassis of the device and is preferably shaped to have maximum protrusion at or near the axle line of the device. The cover could also act as a "panic" pad. This particular cover feature will improve operation of a locking device that passes over intermediate support brackets for the wire. The device by its design and application requires a large working gap between the wire and cam.

Devices that work on a single span wire system also benefit from this additional safety feature, as any operative falling towards the wire and or device would not be able to hold the device in an open position. Track systems also benefit from a similar additional cam locking feature, as the same fall situations occur.

Therefore a new generation of fall arrest devices can be envisaged that have an additional "override" cam locking mechanism that operates separately and or in combination with the primary locking action of the cam. It is also possible to have a device that by its construction has more than one protective cover, perhaps oriented around a device, either equally spaced or at critical positions.

In further embodiments the protective cover can be provided on devices that lock in two directions, each locking feature having the essential pivot and leverage to control the relevant locking action. The feature being either mirrored for the opposite direction of locking or so designed that either direction of movement engages the correct feature to ensure positive locking.

The descriptions above illustrate how the main feature is embodied into several designs, it should also be noted that devices which work in channels, upon track or special sections could use a similar feature.

Devices that are fixed permanently or are removable, such as described in the Applicants' co-pending International Patent Application No. PCT/GB95/00734, can also incorporate some or all of the features described above.

I claim:

1. A fall arrest device for use on an elongate safety line or track, said device comprising:

a body part having retaining means to retain said safety line or track while allowing movement of the body part along the safety line or track;

locking cam means pivotally connected to the body part and having a grip portion at one end thereof for locking the device to said safety line or track in a fall arrest situation, said locking cam means having an unlocked position where said device is freely movable along said safety line of track, and a locked position where said device is firmly locked to said safety line or track;

biasing means to urge said locking cam means into locking engagement with said safety line or track accommodated in said retaining means in the absence of an applied load acting to maintain the locking cam means in an unlocked condition to allow said movement of the body part along the safety line or track; and said locking cam means having an attaching means in another end thereof for attaching personnel safety means to the device;

characterized in that the device further comprises a cover on the side of the body part opposite said retaining means and overlying the portion of said locking cam means having said attaching means to receive loading applied to the device in a direction generally towards said safety line or track engaged in the device in use, one end of said cover being pivotally or rockably connected to said body part and an opposite free end integrally formed with said one end of said cover being in a force transmitting relationship with said locking cam means to apply said loading to said locking cam means when in its unlocked position so as to urge said locking means into its locked position with said safety line or track.

2. A fall arrest device according to claim 1, further including at least one rotary member having at least one recess formed in its periphery, said rotary member being rotatably mounted in relation to said retaining means, and said recess being adapted to traverse support means used to support said safety line or track without the need for user manipulation by rotation of the rotary member relative to said retaining means such that elements of the support means are received, guided and passed by the recess automatically.

3. A fall arrest device according to claim 2, wherein the rotary member is a wheel having a plurality of petals projecting radially from the hub of the wheel, said petals defining between adjacent pairs thereof recesses for traversing said support means.

4. A fall arrest device according to claim 2, wherein said retaining means include at least one slipper element for slidably engaging said safety line or track and cooperating with the wheel such that the wheel can rotate with respect to the slipper element while traversing said support means.

5. A fall arrest device according to claim 1, wherein said cover has a thrust transmitting part in direct contact with said locking cam means.

6. A fall arrest device according to any one of claim 1, wherein said cover transmits said loading to said locking cam means through an intermediate link movably mounted on said body part.

7. A fall arrest device according to claim 1, wherein said cover comprises an elongate generally U-shaped member.

8. A fall arrest device according to claim 1, wherein said cover is adapted to enclose a side edge portion of said body part remote from said safety line or track accommodated, in use, in said safety line retaining means, and any parts of said locking cam means projecting from said side edge portion of the body part.

9. A fall arrest device according to claim 1, wherein said body part has a contact portion which is spaced from said locking cam means and has contact means for engaging said safety line or track which, in use, is retained by said retaining means, wherein said cover is pivotally or rockably connected to said body part in the region of said contact portion of said body part.

* * * * *